US005706803A

United States Patent [19]

Bayer

[11] Patent Number: 5,706,803

[45] Date of Patent: Jan. 13, 1998

[54] DISPOSABLE FACE MASK AND METHOD OF MANUFACTURE

[76] Inventor: Robert T. Bayer, 42 Lakeview Rd., Asheville, N.C. 28804

[21] Appl. No.: 468,529

[22] Filed: Jun. 6, 1995

[51] Int. Cl.[6] ..... A62B 7/10

[52] U.S. Cl. ..... 128/205.27; 128/206.12; 128/206.19

[58] Field of Search ..... 128/205.27, 206.12, 128/206.16, 206.19, 206.21, 201.15, 201.17, 206.24, 206.25; 2/428

[56] References Cited

U.S. PATENT DOCUMENTS

| | | | |
|---|---|---|---|
| 1,292,095 | 1/1919 | Schwartz | 128/206.13 |
| 2,281,181 | 4/1942 | Clarke | 128/206.13 X |
| 2,447,450 | 8/1948 | Williams | 128/206.13 |
| 2,565,124 | 8/1951 | Durborow | 128/206.19 |
| 2,809,633 | 10/1957 | Swearingen et al. | 128/206.25 |
| 2,921,581 | 1/1960 | Swearingen et al. | 128/206.25 |
| 3,834,384 | 9/1974 | Raines | 128/201.15 |
| 3,971,369 | 7/1976 | Aspelin et al. | 128/206.19 |
| 4,302,500 | 11/1981 | Flora | 428/284 |
| 4,319,567 | 3/1982 | Magidson | 128/206.19 |
| 4,355,637 | 10/1982 | Dyer | 128/205.27 |
| 4,397,905 | 8/1983 | Dettmer et al. | 428/343 X |
| 4,419,994 | 12/1983 | Hilton | 128/206.12 |
| 4,546,768 | 10/1985 | Ferierabend | 128/206.24 |
| 4,606,341 | 8/1986 | Hubbard et al. | 128/206.19 |
| 4,628,927 | 12/1986 | Ward | 128/206.19 X |
| 4,688,566 | 8/1987 | Boyce | 128/206.19 |
| 4,883,052 | 11/1989 | Weiss et al. | 128/205.27 |
| 4,920,960 | 5/1990 | Hubbard et al. | 128/206.12 |
| 4,966,140 | 10/1990 | Herzberg | 128/206.25 X |
| 4,969,457 | 11/1990 | Hubbard et al. | 128/206.12 |
| 4,999,235 | 3/1991 | Lunn et al. | 428/156 |
| 5,308,695 | 5/1994 | Arakawa et al. | 428/354 |
| 5,322,061 | 6/1994 | Brunson | 128/206.13 |
| 5,467,765 | 11/1995 | Maturaporn | 128/206.12 |

FOREIGN PATENT DOCUMENTS

| | | | |
|---|---|---|---|
| 2683153 | 5/1993 | France | 128/201.17 |
| 2451402 | 5/1975 | Germany | 128/201.17 |

OTHER PUBLICATIONS

Promotional literature for 3M Elastic Nonwoven Tape by 3M Health Care. Undated.

*Primary Examiner*—Aaron J. Lewis
*Attorney, Agent, or Firm*—Carter & Schnedler, P.A.

[57] ABSTRACT

A disposable, foldable face mask with face seal characteristics consistent with the use of high efficiency filtering media. The mask is made of a single multi-layer, generally rectangular sheet of filter material having a generally straight top edge, a pair of generally straight side edges shorter than the top edge and defining respective top corners with the top edge, and a bottom edge. Midway between the side edges a fold line extends perpendicularly from the top edge to a termination point. The bottom edge has a configuration which is symmetrical on either side of the fold line, and includes a pair of side portions which define respective bottom corners with the side edges. The side portions of the bottom edge extend from the bottom corners to respective transition points. Between the transition points and the fold line termination point there is a generally triangular cutout, such that further portions of the bottom edge extend to the fold line termination point. The sheet is laterally folded on the fold line. On either side of the fold line, the bottom edge side portions and the bottom edge further portions are joined such that a mask body is formed. The mask body is essentially flat for storage and, when unfolded, has an opening defined by the sheet top and side edges and sized to cover the nose and mouth of a wearer. A mask tieing device, such as a pair of conventional ties, is attached to the corners.

20 Claims, 10 Drawing Sheets

DISPOSABLE FACE MASK AND METHOD OF MANUFACTURE

BACKGROUND OF THE INVENTION

The present invention relates generally to disposable face masks and, more particularly, to disposable face masks which have improved face seal characteristics consistent with the use of high efficiency filtering media, and which have a simplified design. The invention also relates to methods for manufacturing a disposable, foldable face mask.

Disposable face masks, particularly for use in the medical field, traditionally have been manufactured in either of two types.

One of these types is known as a pleated face mask, and takes the general form of a relatively flat face panel, rectangular when folded, with either ties or elastic ear loops attached to the corners thereof. The pleats allow the body of the face mask to expand outwardly, so as to loosely cover the mouth and the nose of a wearer. A pleated face mask is made of fabric-like filter material, which typically comprises a sandwich of several layers, such as an outer facing layer, an intermediate filter media layer, and an inner facing layer.

The other common traditional type of face mask is known as a molded cone-style mask, made of a material such as non-woven polyester, which is relatively rigid compared to a pleated mask, but which is nevertheless sufficiently deformable such that the edges thereof can conform, at least approximately, to the shape of a wearer's face to cover the mouth and nose of the wearer. A typical molded cone-style mask has a single elastic head loop attached to the sides thereof, as well as a malleable nose piece in the form of a wire or strip of metal which can be bent so as to maintain the top of the mask in conformity with the shape of the wearer's nose.

Molded cone masks are preferred by some wearers because they remain off the face, that is, out of direct contact with the mouth of the wearer at all times. In contrast, the pleated type mask is subject to billowing out and being pulled back in against the face as the wearer breathes. However, the pleated type mask is preferred by other wearers. The pleated type mask is easier to store and carry, because it can be folded essentially flat.

While these traditional mask types have served for many years, performance requirements for masks have recently increased, particularly in the context of the prevention of the spread of Tuberculosis (TB).

Thus, recent guidelines for the prevention of Tuberculosis call for health care facilities to offer high-efficiency particulate air (HEPA) respirators to their employees who may potentially be exposed to TB. A HEPA filter may have 99.9% Bacteria Filtration Efficiency (BFE) for particles 0.3 microns or larger.

While there do exist filter media which are capable of blocking passage of particles commonly found in health care areas and which can be incorporated into a face mask, traditional face mask constructions as summarized briefly above are not satisfactory in this regard because there is excessive face seal leakage at the mask edges, known as "blow by," to the extent that, regardless of the capabilities of the filter media, excessive quantities of air potentially carrying TB bacilli escape filtering altogether. For example, a pleated face mask is particularly susceptible to face seal leakage along the mask side edges.

SUMMARY OF THE INVENTION

Accordingly, it is an object of the invention to provide a disposable face mask which has a cost comparable to that of traditional face masks, but with improved resistance to leakage, otherwise known as "blow by."

It is another object of the invention to provide a disposable face mask which combines the foldability of a pleated type mask with the off-the-face characteristics of a molded cone type mask.

It is yet another object of the invention to provide a disposable mask which is relatively simple notwithstanding its advantages, and which is amenable to automated manufacturing procedures such that it may be produced at a relatively low cost.

One aspect of the invention is a foldable, disposable face mask which is made of a single, generally rectangular sheet of filter material. Preferably, the sheet of filter material includes multiple layers, such as an outer facing layer, one or more intermediate filter media layers and an inner facing layer.

The generally rectangular sheet of filter material has a generally straight top edge, and a pair of generally straight side edges shorter than the top edge and defining respective top corners with the top edge. There is a fold line midway between the side edges extending perpendicularly to the top edge. The fold line extends from the top edge, preferably a distance less than the length of the side edges to a termination point. The generally rectangular sheet has a bottom edge which has a configuration symmetrical on either side of the fold line.

In one form, the sheet bottom edge has a pair of side portions which define respective bottom corners with the side edges, and which extend generally parallel to the top edge a distance from the bottom corners to respective transition points. Between these two transition points and the termination point of the fold line there is a generally triangular cutout. Thus, beginning at the transition points, the bottom edge includes a pair of further portions extending from the respective transition points in directions generally angled upwardly towards the top edge to the fold line termination point. Preferably, these further portions extending from the transition points are arcuate in configuration, convex with reference to the material which remains after the cutout.

The sheet is laterally folded on the fold line. By ultrasonic bonding, for example, the bottom edge side portions are joined to each other and the bottom edge further portions on either side of the fold line are joined to each other such that a mask body is formed. The mask body is essentially flat for storage and, when unfolded, has an opening defined by the sheet top and side edges and size to cover the nose and mouth of a wearer. A mask tieing device, such as a pair of conventional ties, is attached to the corners.

When placed over the mouth and nose of the wearer, the side edges provide a relatively flat sealing surface to the wearer's face, extending under the chin, while the top edge provides a relatively flat sealing surface across the face and nose of the wearer. Preferably, a conventional malleable nose-piece, such as a wire or strip of metal, extends adjacent the top edge for maintaining the top edge in conformity with the shape of the wearer's nose.

In one embodiment, a pair of mask tieing devices are attached to the top corners. One of the mask tieing devices, comprising a pair of conventional ties for example, is arranged to extend generally over the top of the wearer's head for urging that portion of the mask opening defined by the sheet side edges into tight engagement with the wearer, particularly under the chin. The other of the mask tieing devices, which likewise may take the form of a pair of conventional ties, is arranged to extend generally about the back of the wearer's head for urging that portion of the opening defined by the sheet top edge into tight engagement with the wearer.

In another embodiment, the other of the mask tieing devices takes the form of an elastic head loop. In yet another embodiment, the other of the mask tieing devices takes the form of a pair of elastic ear loops.

In accordance with the invention, additional measures may be taken for improving the face seal characteristics, that is, reducing "blow by."

In one embodiment, a foam sealing strip is attached to the inside surface of the sheet (with reference to the opening) adjacent the edges defining the opening.

In another embodiment, a strip of bidirectional elastic adhesive tape is applied to the outside surface of the sheet (with reference to the opening), adjacent to and overlapping the edges defining the opening. The overlapping portions of the elastic adhesive tape are adhered directly to the face of the wearer, thereby enhancing the face seal.

One method in accordance with the invention for manufacturing a foldable, disposable face mask includes the steps of providing a rectangular sheet of filter material with top and bottom edges, and with side edges shorter than the top and bottom edges. Next, a generally triangular portion is cut out of the sheet at the midpoint of the bottom edge. The triangular cutout portion preferably has arcuate edges, convex with reference to the remaining filter material. Mask ties are attached to the corners where the side edges intersect the top edge. The sheet is laterally folded along a fold line such that the side edges are in alignment, and the bottom edges and edges of the cutout are joined on either side of the fold line, such as by ultrasonic bonding. Preferably, at some point in the process, a malleable nose-piece is applied along the upper edge opposite the location of the triangular portion cut.

The face mask construction of the invention lends itself to automated manufacture at a relatively low cost. Thus, an automated method of manufacturing foldable, disposable face masks includes the steps of providing a web of filter material having a width defined between upper and lower edges corresponding to the height of masks to be made. Generally triangular portions of the web are cut out at intervals along the lower edge, corresponding to the lateral center of each mask to be manufactured. Preferably, the generally triangular portions have arcuate edges, convex with reference to the filter material which remains.

The web is cut into individual lengths of filter material corresponding to the widths of the masks, thus defining individual mask blanks with the cuts defining mask side edges. Ties are then attached along the mask blank side edges, extending past the upper edges. The mask blanks are then laterally folded along fold line such that the mask blank side edges are in alignment, and the bottom edges on either side of the fold lines are joined, such as by ultrasonic bonding. At some point in the process, prior to folding the mask blanks, malleable nose pieces are applied along the upper edge, opposite the locations of the triangular portion cuts.

The resultant mask configuration advantageously has enhanced face sealing characteristics with reference to either the traditional pleated mask or molded cone mask configurations summarized hereinabove, has the foldability characteristic of the traditional pleated mask, and has the off-the-face characteristic of a molded cone mask. Moreover, the mask of the invention is relatively simple to construct, and is amenable to automated production at relatively low cost.

BRIEF DESCRIPTION OF THE DRAWINGS

While the novel features of the invention are set forth with particularity in the appended claims, the invention, both as to organization and content, will be better understood and appreciated, from the following detailed description, taken in conjunction with the drawings, in which:

DETAILED DESCRIPTION

Figure 1:
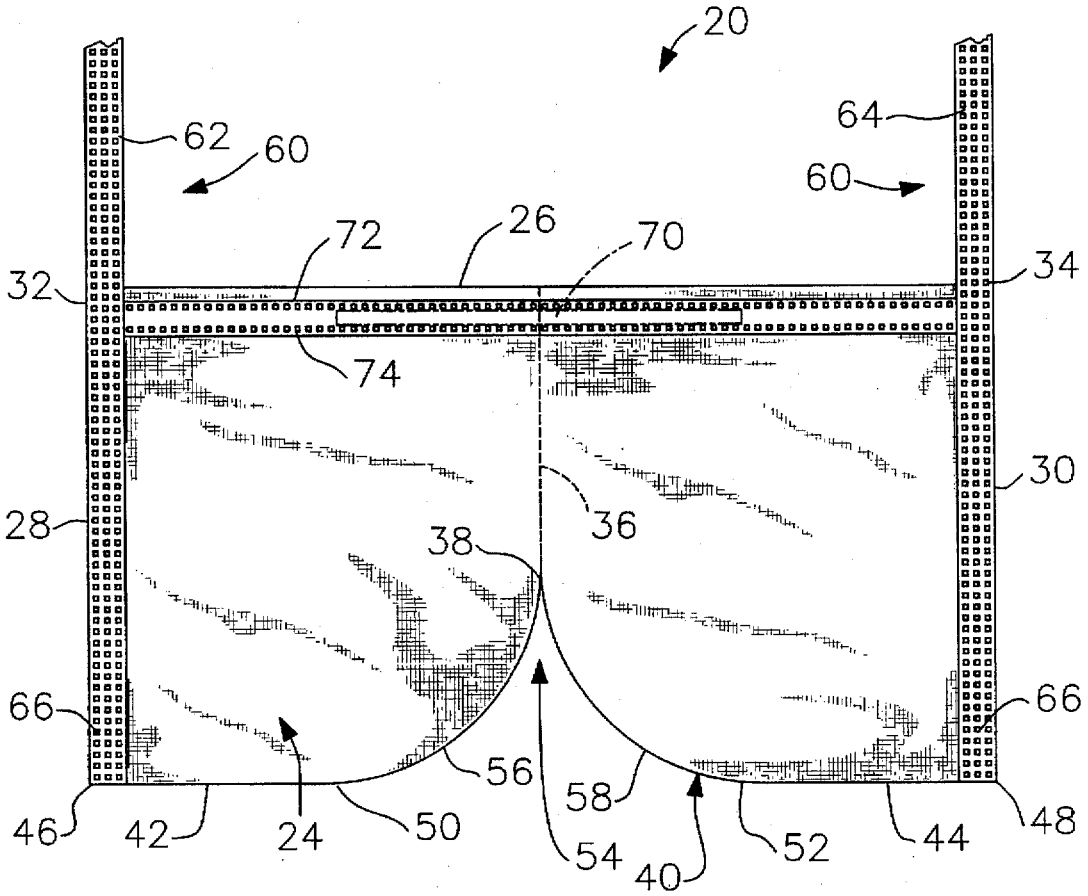
FIG. 1 depicts a mask precursor at an intermediate stage of manufacture, prior to folding.
Figure 2:
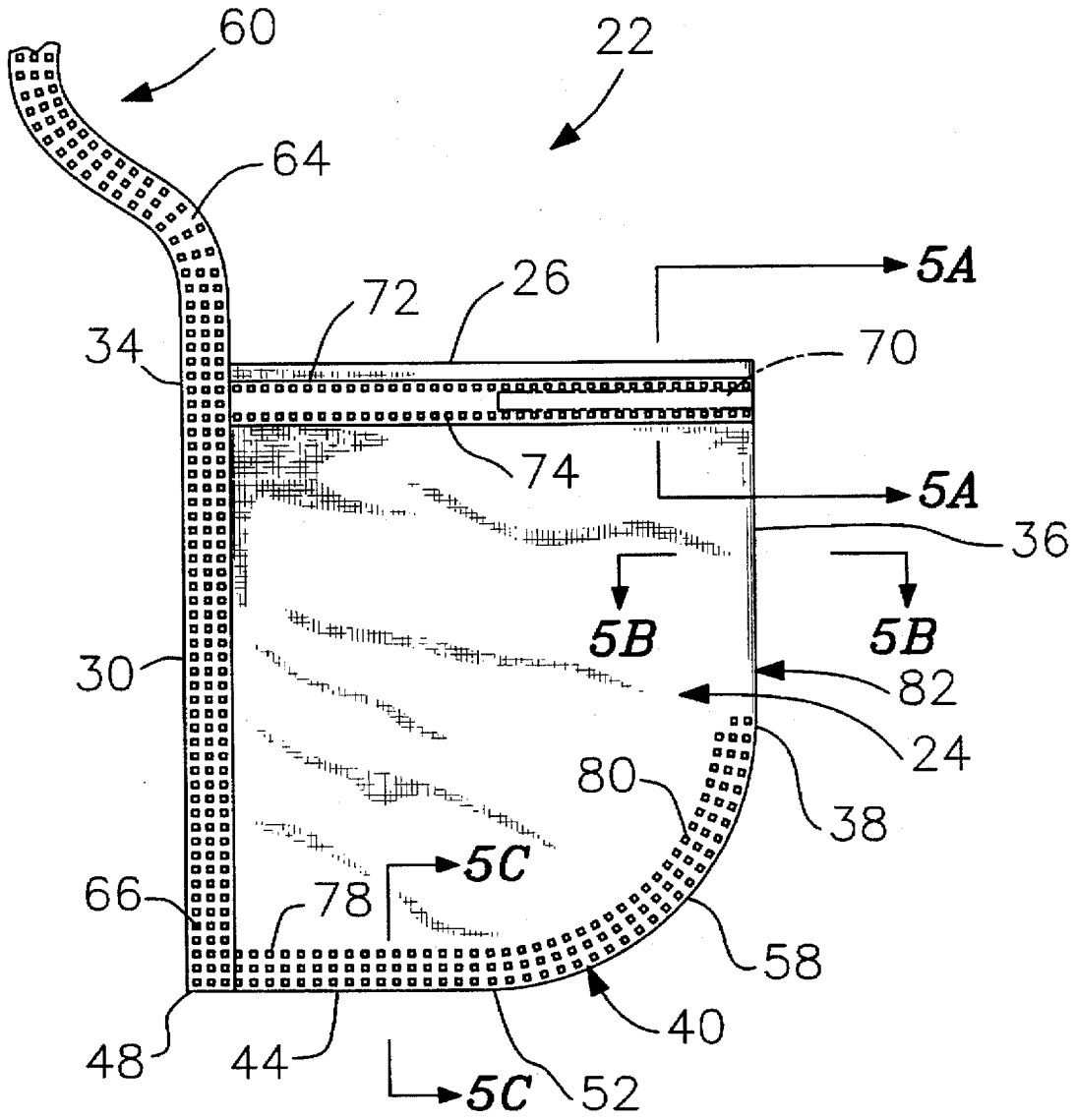
FIG. 2 depicts a mask in accordance with the invention in its folded form.
Figure 3:
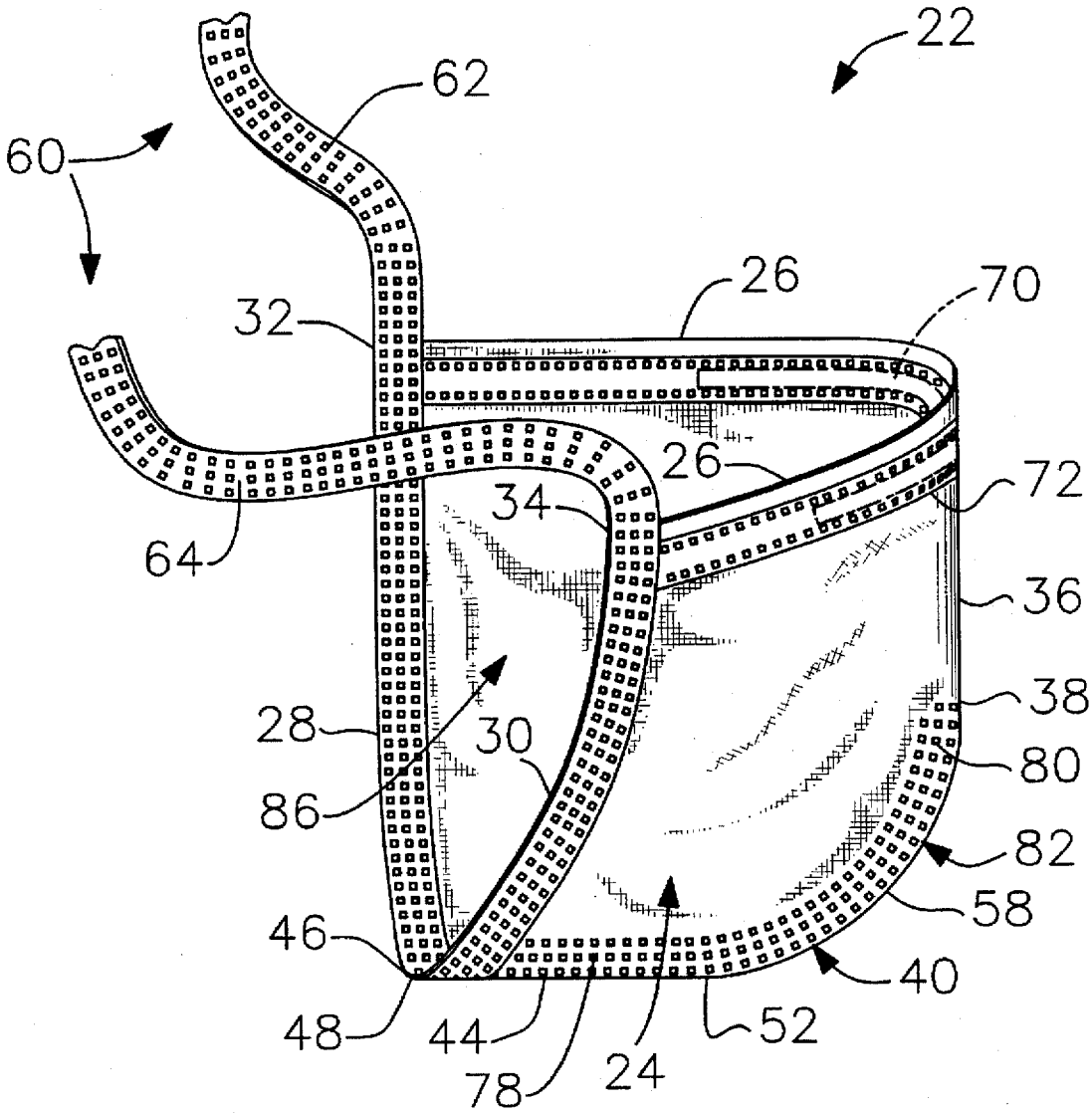
FIG. 3 is a perspective view of the mask of FIG. 2 unfolded to define an opening.
Figure 4:
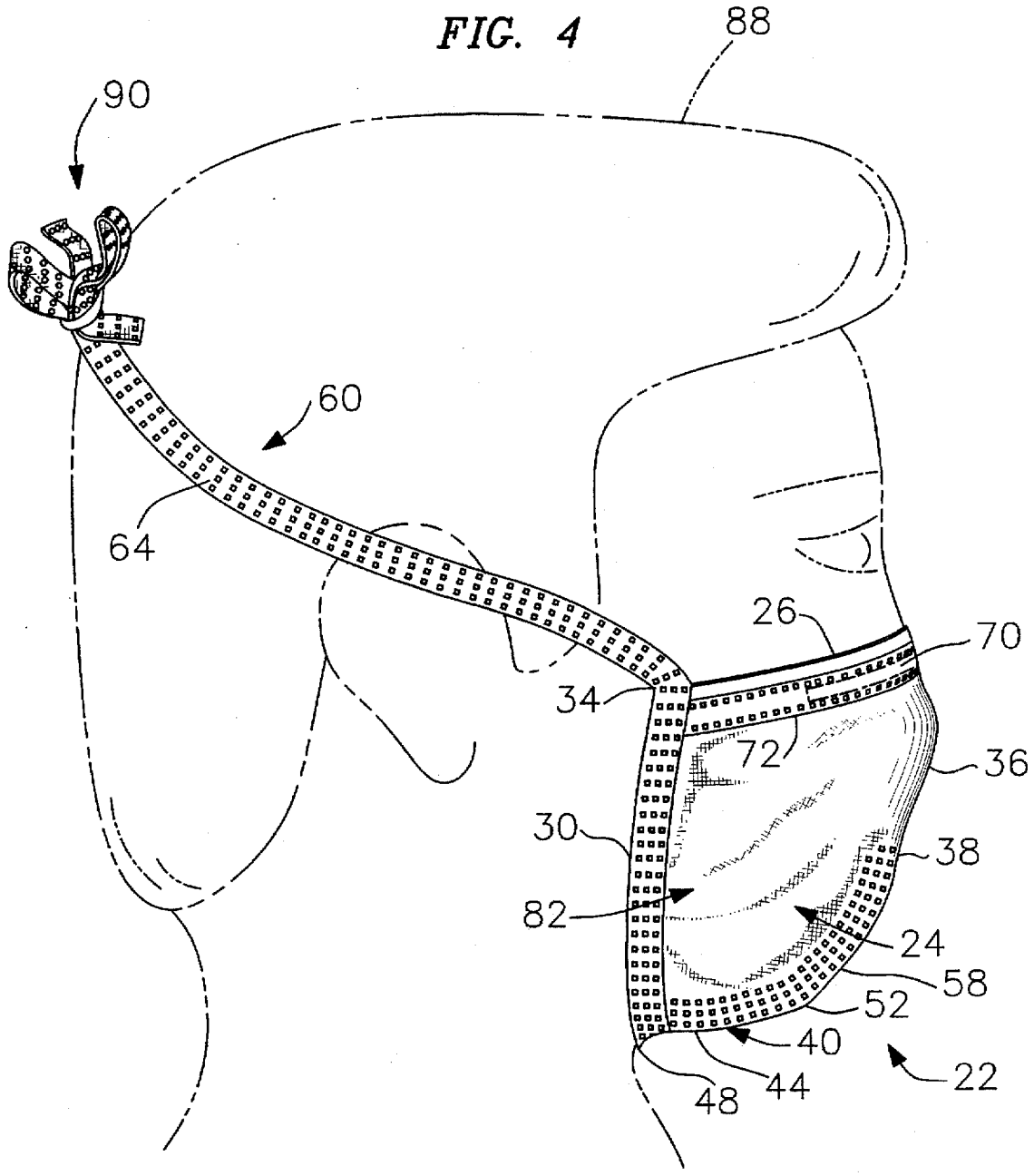
FIG. 4 is a side view of the mask of FIGS. 2 and 3 in position over the face of a wearer.

Referring now to the drawings, FIG. 1 depicts a mask precursor 20 at an intermediate stage of manufacture, and FIGS. 2, 3, and 4 depict a completed mask 22.

The precursor 20 and mask 22 include a single, preferably multi-layer generally rectangular sheet of filter material, generally designated 24, which, as best seen in the precursor 20 of FIG. 1 prior to folding, has a generally straight top edge 26, and a pair of generally straight side edges 28 and 30 each shorter than the top edge 26 and defining, with the top edge 26, respective top corners 32 and 34. Midway between the side edges 28 and 30 is a fold line 36, which extends from the top edge 28 perpendicularly to the top edge 26 to a termination point 38. Opposite the top edge 26 is a bottom edge, generally designated 40, which has a configuration that is symmetrical on either side of the fold line 36.

More particularly, the bottom edge 40 has a pair of side portions 42 and 44 defining respective bottom corners 46 and 48 with the side edges 28 and 30. The side portions 42 and 44 extend generally parallel to the top edge 26 equal distances from the respective bottom corners 46 and 48 to respective transition points 50 and 52. Between the transition points 50 and 52 and the termination point 38 of the fold line 36 is a generally triangular cutout 54. Thus, the bottom edge 40 continues, from the transition points 50 and 52, along a pair of further edge portions 56 and 58 which are defined by the cutout 54 and which extend in directions generally angled upwardly towards the top edge 26 and, more particularly, to the fold line 36 termination point 38. Although the triangular cutout 54 may have straight sides such that the further portions 56 and 58 are straight, preferably these further portions 56 and 58 are arcuate in configuration, convex with reference to the filter material 24 which remains following the removal of material to form the cutout 54.

A mask tieing device, generally designated 60, is attached to the top corners 32 and 34. In the illustrated embodiment, the mask tieing device 60 takes the form of a pair of conventional ties 62 and 64, made of a material such as spunbonded polypropylene, extending along the side edges 28 and 30, and attached to the sheet 24 along the side edges 28 and 30 by means of conventional ultrasonic bonding, for example, which generates heat to fuse the materials, employing a suitable fixture which produces individual ultrasonic bond dimples 66.

While the generally triangular cutout 54 is preferred to prevent a pointed projection on the finished mask 22, it will be appreciated that the cutout 54 is optional. In the illustrated embodiment, the fold line 36 extends from the top edge 28 a distance less than the length of the side edges 28 and 30. If the cutout 54 is eliminated, the fold line 36 is the same length as the side edges 28 and 30, and the bottom edge 40 is straight like the top edge 26.

To enable the top edge 26 to be maintained in conformity with the shape of the nose of a wearer, a malleable nose piece 70 is provided, shown in phantom since it is hidden by an overlying piece of retaining strip material 72, which may be spun-bonded polypropylene. The retaining strip 72 is attached to the underlying sheet of material 24, such as by ultrasonic bonding represented by dimples 74. In a typical manufacturing process, the malleable nose piece 70 and the retaining strip 72 therefor are attached prior to attachment of the ties 62 and 64. Accordingly, in FIGS. 1–4, the ties 62 and 64 overlap the retaining strip 72.

The mask precursor 20 of FIG. 1 is formed into the finished mask 22 of FIGS. 2–4 by laterally folding on the fold line 36, joining the bottom edge side portions 42 and 44 to each other, and joining the bottom edge further portions 56 and 58 on either side of the fold line 36 to each other, as represented by ultrasonic thermal bond dimples 78 and 80, respectively. A suitable ultrasonic thermal bonding fixture is employed to simultaneously form all of the dimples 78 and 80. The resultant mask 22 comprises a body 82 and the tieing device 60.

As represented in FIG. 2, the body 82 of the mask 22 has an essentially flat configuration for storage and, when opened for use as shown in FIG. 3, has an opening 86 defined by the sheet top 26 and side edges 28 and 30, and sized to cover the nose and mouth of a wearer.

FIG. 4 more particularly shows the body 82 of the mask 26 attached over the mouth and nose of a wearer 88, with the tieing device 60, represented by tie 64 and bow knot 90, holding the mask 22 body 82 snugly in position.

From the geometry of FIG. 4, it will be appreciated that the tieing device 60 represented by tie 64 exerts a diagonally upwardly and rearward force at the corner 34, such that peripheral portions of the mask 22 and body 82 at opening 86 defined by the side edges 28 and 30 remain tightly against the wearer's skin in sealing engagement, particularly under the chin. Similarly, the peripheral portion of the mask 22 body 82 adjacent the upper edge 26 remains in sealing engagement above the nose, aided by use of the malleable nose piece 70. Although made of filter material similar to that of pleated type face masks, the mask 22 has the off-the-face characteristic of a molded cone mask.

Preferably, the mask 22 is produced in various sizes to reliably fit a wide variety of individual faces.

Figure 5A:
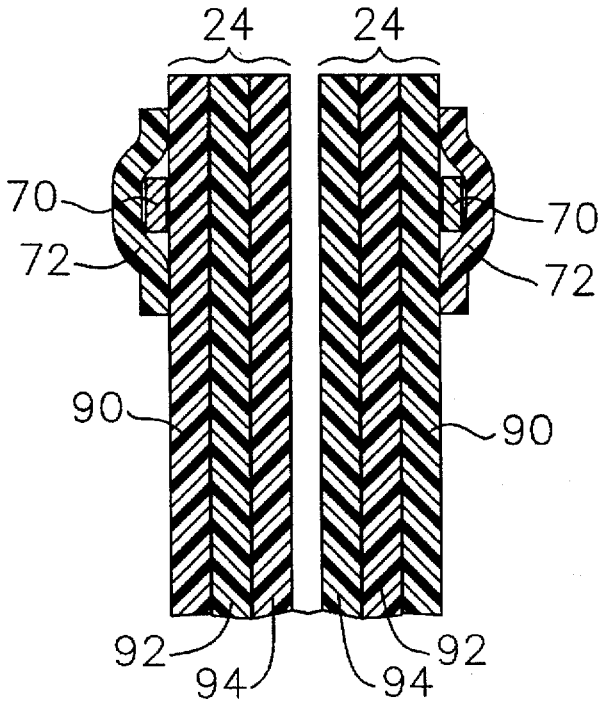
FIG. 5A is a section on line 5A—5A of FIG. 2.
Figure 5C:
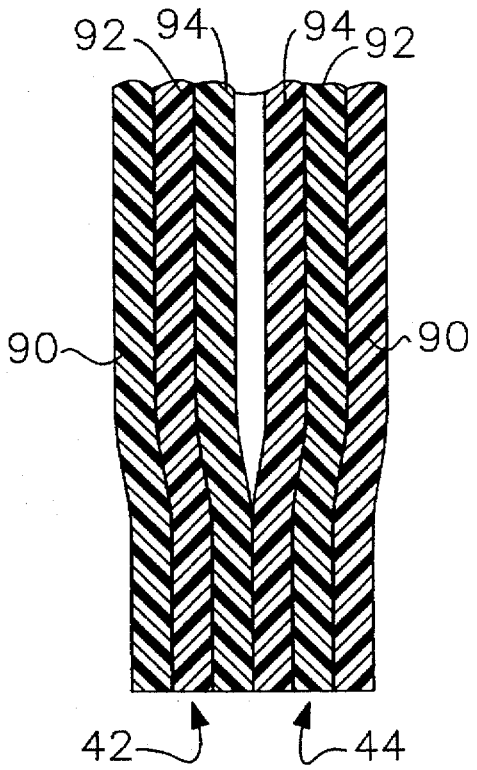
FIG. 5C is a section on line 5C—5C of FIG. 2.
Figure 5B:
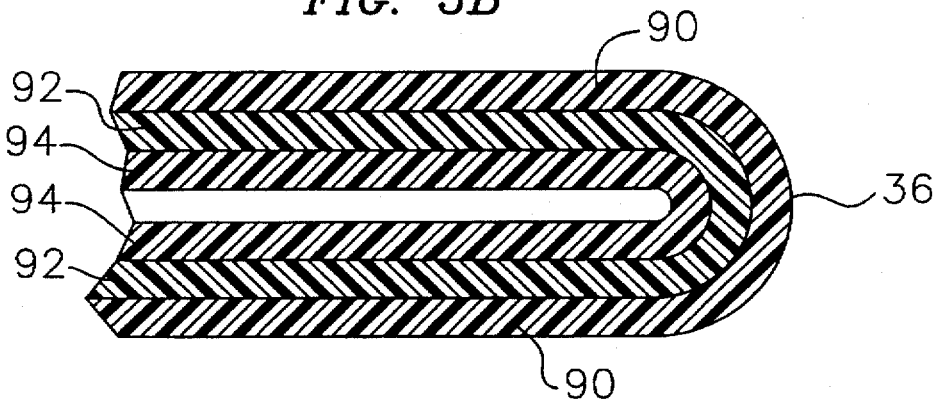
FIG. 5B is a section on line 5B—5B of FIG. 2.

With reference to the cross sections of FIGS. 5A, 5B and 5C, the rectangular sheet of filter material 24 more particularly comprises a sandwich of materials, including an outer facing layer 90, an intermediate filter media layer 92 or layers and an inner facing layer 94. Various materials may be employed. For example, the outer facing layer 90 may be made of spunbonded polypropylene, the filter media layer 92 of meltblown polypropylene, and the inner facing layer 94 of spunbonded polypropylene, tissue, or a cellulosic material. By way of example, the media layer 92 is meltblown polypropylene.

FIG. 5A more particularly depicts the manner in which the malleable nose piece 70 is retained by the retaining strip 72. FIG. 5B depicts the fold 36 at the front of the mask 22, and FIG. 5C depicts the joining of the bottom edge portions 42 and 44.

Figure 6:
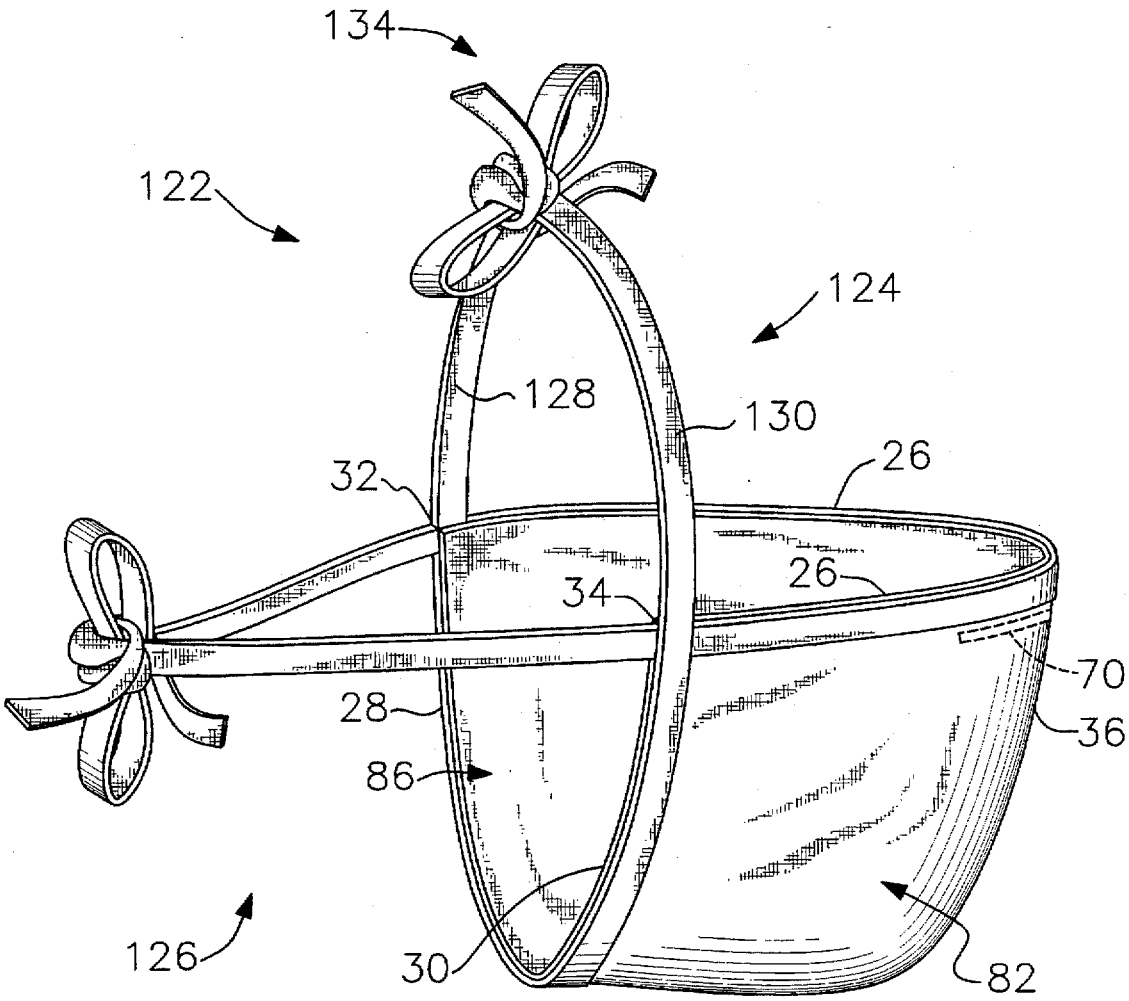
FIG. 6 is a view comparable to FIG. 3, showing an alternative embodiment with a pair of mask tieing devices.

FIG. 6 depicts an alternative mask embodiment 122 wherein there are a pair of mask tieing devices, generally designated 124 and 126, attached to the top corners 32 and 34. Elements of the mask 122 of FIG. 6 which correspond to elements of the mask 22 of FIGS. 1–4 are designated with identical reference numerals, and generally are not further described hereinbelow.

More particularly, one of the mask tieing devices, in particular the mask tieing device 24, takes the form of two conventional ties 128 and 130, which during use are tied to each other by means of a bow knot 134. The mask tieing device 124 accordingly is arranged to extend generally over the top of the wearer's head, for urging that portion of the opening 86 defined by the sheet side edges 28 and 30, into tight engagement with the wearer.

The other of the mask tieing devices 126 likewise comprises a pair of conventional ties 136 and 138 which, during use, are attached to each other by means of a bow knot 140. The mask tieing device 126 is thus arranged to extend generally about the back of the wearer's head for urging that portion of the opening defined by the sheet top edge 26 into tight engagement with the wearer, aided by the malleable nose piece 70.

Figure 7:
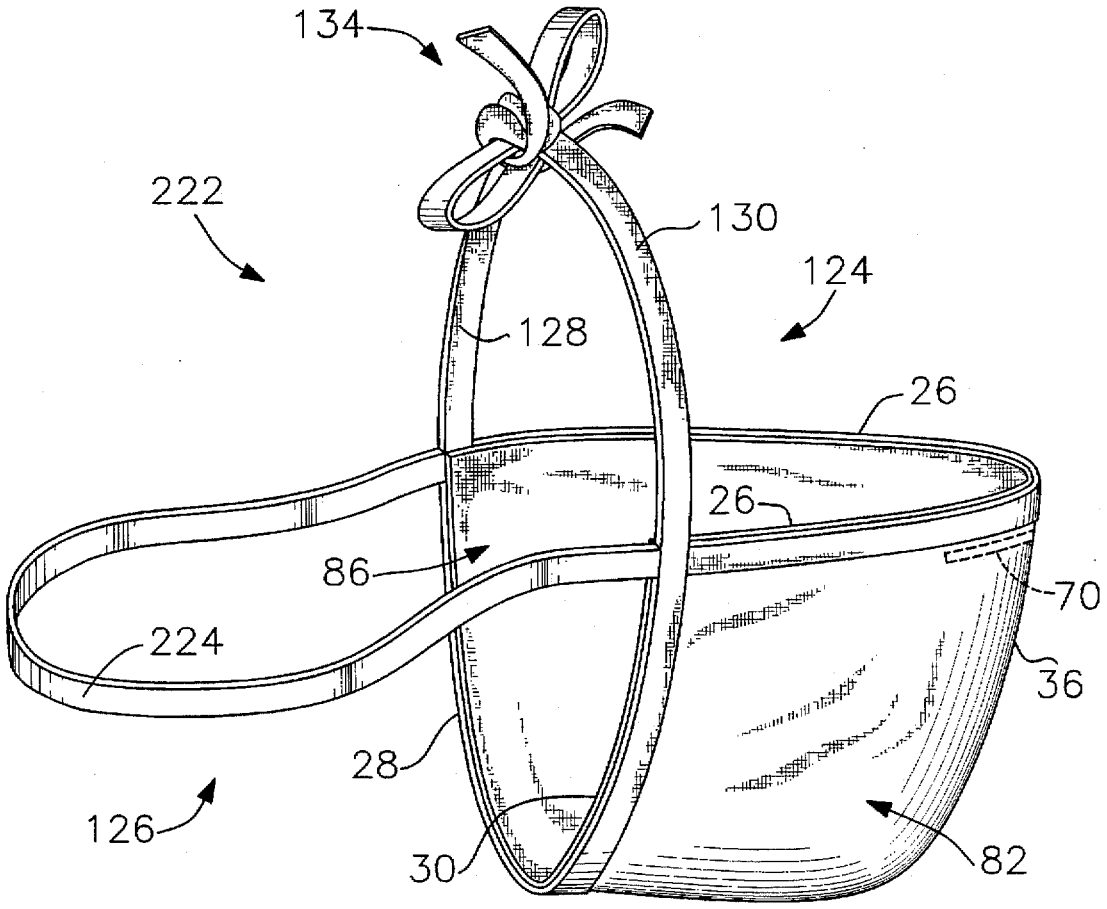
FIG. 7 is yet another alternative embodiment, wherein one of the mask tieing devices of FIG. 6 is replaced by an elastic head loop.

FIG. 7 depicts another mask embodiment 222 where, again, elements corresponding to elements in the other mask embodiments are designated with identical reference numerals, and not further described. The mask 222 of FIG. 7 represents a modification of the mask 122 of FIG. 6 wherein the tieing device 126 arranged to extend generally about the back of the wearer's head takes the form of an elastic head loop 224, which may be made of a spun bond laminate, laminated to stretch fiber. For manufacturability, it is preferred that the elastic head loop 224 have an unstretched length which is the same as the length of the top edge 26 and retaining strip 72, as best seen in FIG. 1. Thus, during automated manufacture, material for the elastic head loop is placed in a continuous strip along the upper edge 26 (on the reverse side of the filter material sheet 24, opposite the nose-piece retaining strip 72 material), and attached to the corners 32 and 34, prior to the cutting which defines the side edges 28 and 30 of an individual mask blank or precursor 20.

Figure 8:
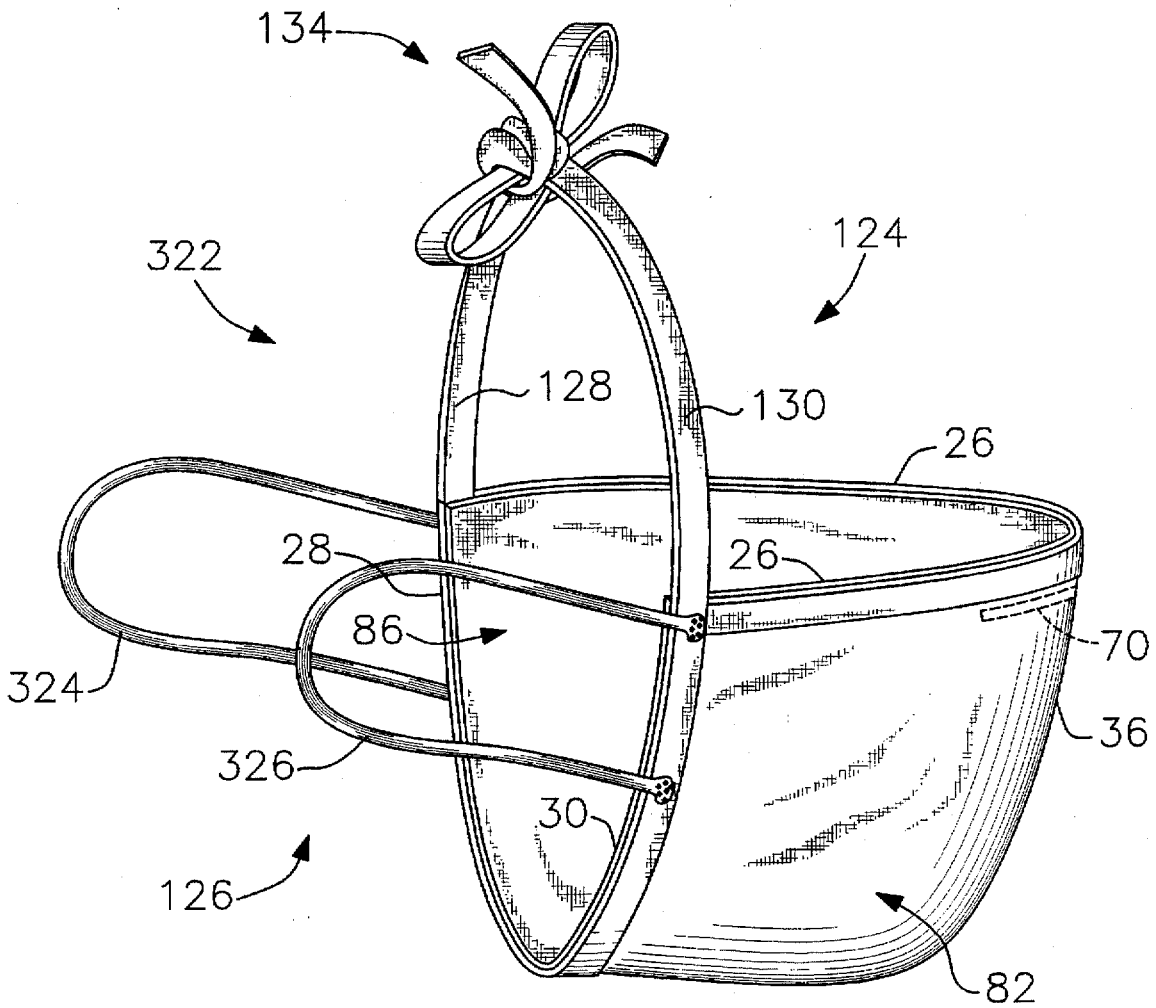
FIG. 8 is yet another alternative embodiment, wherein one of the mask tieing devices of FIG. 6 is replaced by a pair of elastic ear loops.

FIG. 8 depicts yet another embodiment 322, employing a further form of mask tieing device 126. In particular, the mask tieing device 126 of FIG. 8 comprises a pair of elastic ear loops 324 and 326, made for example of polyester and lycra ultrasonically bonded to the body 82 of the mask 322. The ear loops 324 and 326 are similar to ear loops employed in some styles of traditional pleated type face masks.

Figure 9:
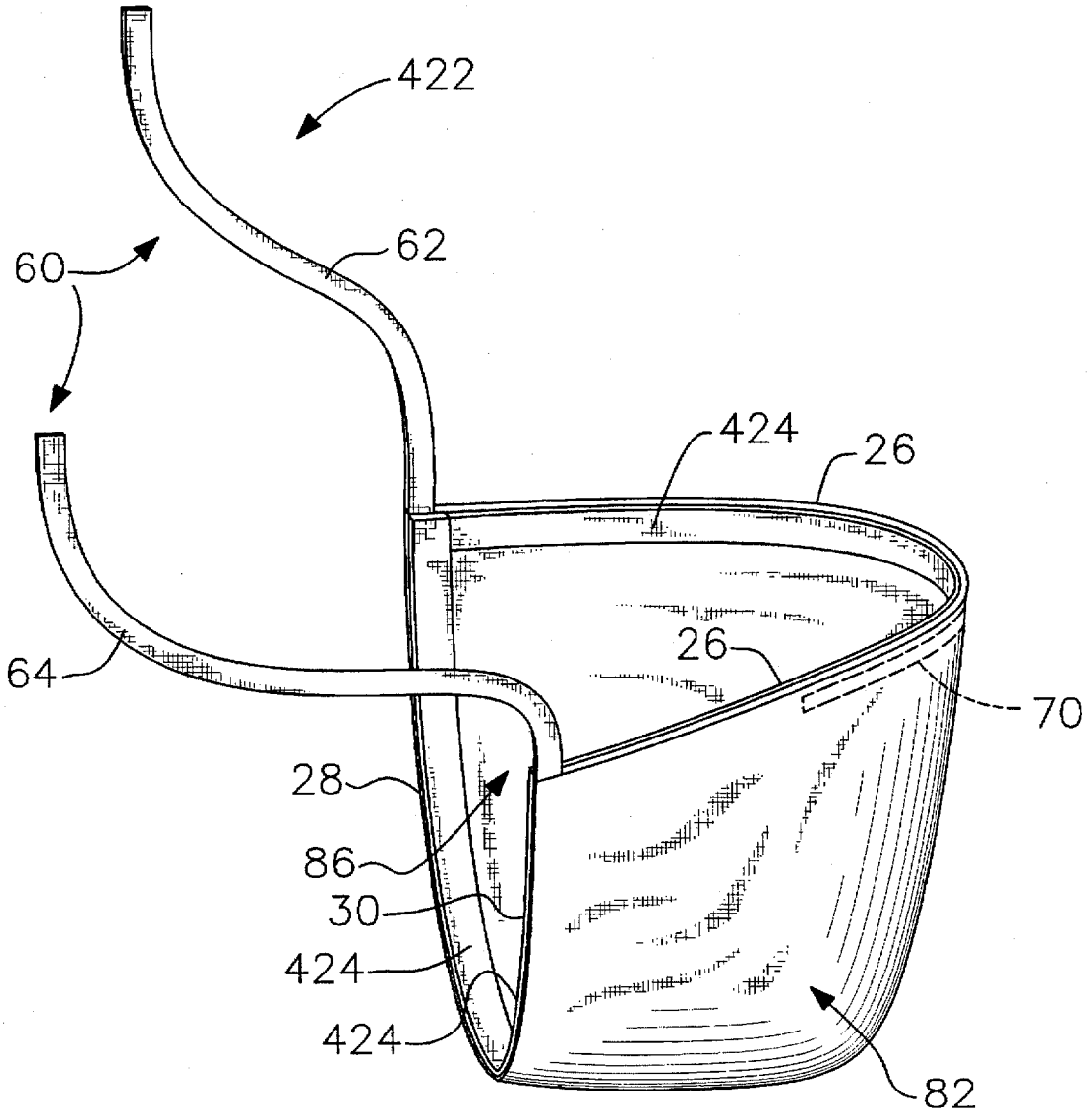
FIG. 9 is a perspective view of an embodiment of the invention incorporating a foam sealing strip.

FIG. 9 depicts yet another mask embodiment 422, which is a modification of the mask 22 of FIGS. 1–4, wherein, to provide an enhanced face seal, foam sealing strips 424 are applied to the inside surface of the sheet of filter material 24, (outside with reference to the opening 86). A suitable material for the sealing strip 424 is cross-linked polyethylene foam.

Figure 10:
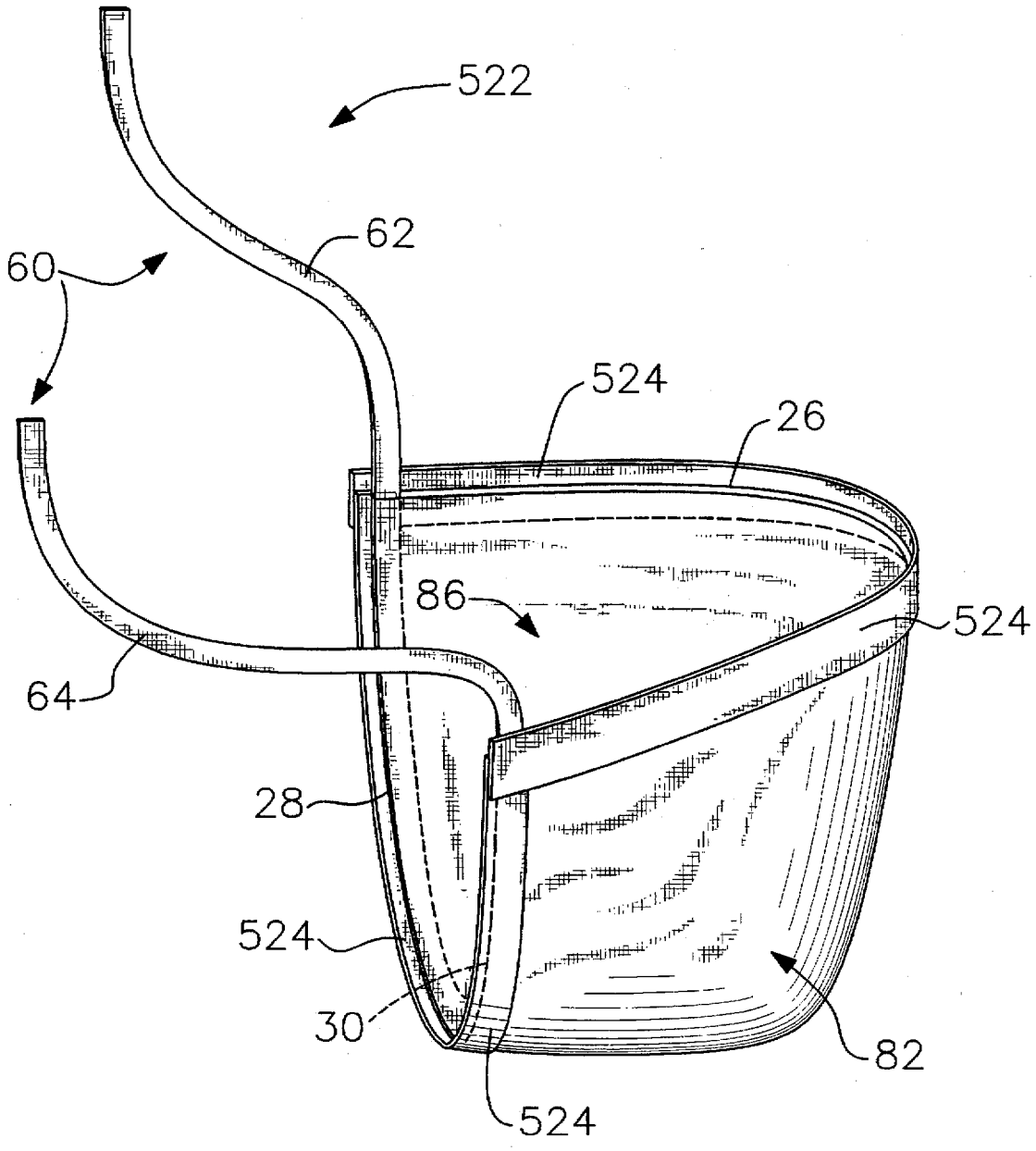
FIG. 10 is a perspective view of an embodiment of the invention incorporating bidirectional elastic adhesive tape for enhanced sealing.

Referring finally to FIG. 10, another mask embodiment 522, which likewise is a modification of the mask 22 of FIGS. 1–4, for enhanced sealing includes strips of bidirectional elastic adhesive tape 524 applied to the outside surface of the sheet of filter material (outside with reference to the opening 86) adjacent the edges 26, 28 and 30 defining the opening. The bidirectional elastic adhesive tape 524 may comprise 3M elastic non-woven tape available from 3M Healthcare, with the adhesive side contacting the wearer's face, providing a tight seal. The bidirectional stretch nature of the tape permits the wearer to change facial expressions and speak readily, without compromising the seal.

In a typical automated process for manufacturing masks of the invention, a continuous web of filter material is provided, in the form of a sandwich including the outer facing layer material, the intermediate filter media layer material, and the inner facing layer material. The width of the web corresponds to the height of the ultimate masks.

As the web travels through a machine, generally triangular portions of the web are cut out at intervals along the lower edge at positions corresponding to the lateral center of each mask. The web is then cut into individual lengths of filter material corresponding to the widths of the face masks to define individual mask blanks or precursors, these transverse cuts defining mask side edges. Ties are attached along the mask blank side edges, extending past the upper edges, such as by ultrasonic bonding.

The mask blanks or precursors are then laterally folded along fold lines such that the mask blank side edges are in alignment. Finally, the bottom edges are joined, such as by ultrasonic bonding, on either side of the fold lines. At an appropriate point in the process, prior to folding the mask blanks or precursors, malleable nose pieces are applied along the upper edge opposite the locations of the triangular portion cuts.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of invention.

What is claimed is:

1. A foldable, disposable face mask comprising:

a single generally rectangular sheet of filter material having a generally straight top edge, a pair of generally straight side edges shorter than said top edge and defining respective top corners with said top edge, a fold line midway between said side edges extending perpendicularly to said top edge from said top edge a distance less than the length of said side edges to a termination point, and a bottom edge opposite said top edge and having a configuration symmetrical on either side of the fold line;

said sheet bottom edge having a pair of side portions defining respective bottom corners with said side edges and extending generally parallel to said top edge a distance from the respective bottom corners to respective transition points, and a pair of further portions extending from respective ones of the transition points in directions generally angled upwardly towards said top edge to said fold line termination point;

said sheet being folded on said fold line, said bottom edge side portions being joined to each other and said bottom edge further portions on either side of the fold line being joined to each other such that a mask body is formed which is essentially flat for storage and which, when unfolded, has an opening defined by said sheet top and side edges and sized to cover the nose and mouth of a wearer; and a mask tieing device attached to the top corners.

2. The mask of claim 1, wherein said sheet of filter material comprises multiple layers.

3. The mask of claim 2, wherein said sheet of filter material comprises an outer facing layer, an intermediate filter media layer, and an inner facing layer.

4. The mask of claim 1, which further comprises a malleable nose-piece extending adjacent said top edge for conforming said top edge to the wearer's nose.

5. The mask of claim 1, wherein said further portions of said sheet bottom edge are arcuate in configuration, convex with reference to said sheet.

6. The mask of claim 1, which comprises a pair of mask tieing devices attached to the top corners, one of said mask tieing devices arranged to extend generally over the top of the wearer's head for urging a portion of the opening defined by said sheet side edges into tight engagement with the wearer, and the other of said mask tieing devices arranged to extend generally about the back of the wearer's head for urging a portion of the opening defined by said sheet top edge into tight engagement with the wearer.

7. The mask of claim 6, wherein said other of said mask tieing devices comprises an elastic head loop.

8. The mask of claim 6, wherein said other of said mask tieing devices comprises a pair of elastic ear loops.

9. The mask of claim 1, which further comprises a foam sealing strip attached to the inside surface of the sheet with reference to the opening adjacent the edges defining the opening.

10. The mask of claim 1, which further comprises a strip of bidirectional elastic adhesive tape applied to the outside surface of the sheet with reference to the opening adjacent to and overlapping the edges defining the opening.

11. A foldable, disposable face mask comprising:

a single generally rectangular sheet of filter material having a generally straight top edge, a pair of generally straight side edges shorter than said top edge and defining respective top corners with said top edge, a fold line midway between said side edges extending perpendicularly to said top edge from said top edge and a bottom edge opposite said top edge and having a configuration symmetrical on either side of the fold line;

said sheet being folded on said fold line, portions of said bottom edge on either side of the fold line being joined to each other such that a mask body is formed which is essentially flat for storage and which, when unfolded, has an opening defined by said sheet top and side edges and sized to cover the nose and mouth of a wearer; and a mask tieing device attached to the top corners.

12. The mask of claim 11, wherein said sheet of filter material comprises multiple layers.

13. The mask of claim 11, wherein said sheet of filter material comprises an outer facing layer, an intermediate filter media layer, and an inner facing layer.

14. The mask of claim 11, which further comprises a malleable nose-piece extending adjacent said top edge for conforming said top edge to the wearer's nose.

15. A method of manufacturing foldable, disposable face masks, comprising:

providing a web of filter material having a width defined between upper and lower edges corresponding to the height of the masks;

cutting out generally triangular portions of the web at intervals along the lower edge at positions corresponding to the lateral center of each mask;

cutting the web into individual lengths of filter material corresponding to the widths of the masks to define individual mask blanks, the cuts defining mask side edges;

attaching ties along the mask blank side edges and extending past the upper edges;

laterally folding the mask blanks along fold lines such that the mask blank side edges are in alignment; and joining the lower edges and edges of the generally triangular cutout of each of the mask blanks on either side of the fold lines, the generally triangular cutout serving to avoid what would otherwise be a pointed projection on each of the finished masks.

16. The method of claim 15, which further comprises, prior to folding the mask blanks, applying malleable nose-pieces along the upper edge opposite the locations of the triangular portion cuts.

17. A method of manufacturing foldable, disposable face masks, comprising:

providing a web of filter material having a width defined between upper and lower edges corresponding to the height of the masks;

cutting out generally triangular potions of the web at intervals along the lower edge at positions corresponding to the lateral center of each mask while providing the generally triangular portions with arcuate edges which are convex with reference to the remaining filter material;

cutting the web into individual lengths of filter material corresponding to the widths of the masks to define individual mask blanks, the cuts defining mask side edges;

attaching ties along the mask blank side edges and extending past the upper edges;

laterally folding mask blanks along fold lines such that the mask blank side edges are in alignment; and joining the bottom edges and arcuate edges of the generally triangular cutout of each of the mask blanks on either side of the fold lines, the generally triangular cutout serving to avoid what would otherwise be a pointed projection on each of the finished masks.

18. A method of manufacturing a foldable, disposable face mask, comprising:

providing a rectangular sheet of filter material with top and bottom edges and with side edges shorter than the top and bottom edges, the side edges intersecting the top edge at top corners;

cutting out a generally triangular portion of the sheet at the midpoint of the bottom edge;

attaching mask ties at the top corners;

laterally folding the sheet along a fold line such that the side edges are in alignment; and joining the bottom edges and edges of the generally triangular cutout on either side of the fold line, the generally triangular cutout serving to avoid what would otherwise be a pointed projection on the finished mask.

19. The method of claim 18, which further comprises, prior to folding, applying a malleable nose-piece along the upper edge opposite the location of the triangular portion cut.

20. A method of manufacturing a foldable, disposable face mask, comprising:

providing a rectangular sheet of filter material with top and bottom edges and with side edges shorter than the top and bottom edges;

cutting out a generally triangular portion of the sheet at the midpoint of the bottom edge while providing the generally triangular portion with arcuate edges which are convex with reference to the remaining filter material;

attaching mask ties to the corners where the side edges intersect the top edge;

laterally folding the sheet along a fold line such that the side edges are in alignment; and joining the bottom edges and edges of the generally triangular cutout on either side of the fold line, the generally triangular cutout serving to avoid what would otherwise be a pointed projection on the finished mask.

* * * * *